US009192210B2

(12) United States Patent
Mordecai et al.

(10) Patent No.: US 9,192,210 B2
(45) Date of Patent: Nov. 24, 2015

(54) PROTECTIVE GARMENT HAVING A THERMALLY REFLECTIVE LAYER

(75) Inventors: Mark Mordecai, Hampton, NH (US); Roland F. Landry, Lewiston, ME (US); Neil S. Hanley, Hartford, ME (US)

(73) Assignee: GLOBE HOLDING COMPANY LLC, Pittsfield, NH (US)

( * ) Notice: Subject to any disclaimer, the term of this patent is extended or adjusted under 35 U.S.C. 154(b) by 401 days.

(21) Appl. No.: 12/941,406

(22) Filed: Nov. 8, 2010

(65) Prior Publication Data

US 2011/0107621 A1 May 12, 2011

Related U.S. Application Data

(60) Provisional application No. 61/259,426, filed on Nov. 9, 2009.

(51) Int. Cl.

| | |
|---|---|
| ***A43B 3/00*** | (2006.01) |
| ***A43B 23/00*** | (2006.01) |
| ***A43B 23/07*** | (2006.01) |
| ***A62D 5/00*** | (2006.01) |
| ***A43B 7/32*** | (2006.01) |
| ***A43B 3/02*** | (2006.01) |
| ***A43B 23/02*** | (2006.01) |

(52) U.S. Cl.

CPC ... *A43B 7/32* (2013.01); *A43B 3/02* (2013.01); *A43B 23/022* (2013.01); *A43B 23/0235* (2013.01)

(58) Field of Classification Search

CPC ..... A43B 1/08; A43B 1/02; A43B 1/04; A43B 7/34; A43B 23/023

USPC ..... 36/113, 36 B, 37, 45, 46.5; 428/473, 428/699, 689, 295.1, 200, 913, 540, 305.5, 428/313.9, 474.4; 442/232

See application file for complete search history.

(56) References Cited

U.S. PATENT DOCUMENTS

| | | | | | |
|---|---|---|---|---|---|
| 3,356,555 | A | * | 12/1967 | Jackson | 156/205 |
| 3,551,389 | A | * | 12/1970 | Prince, Jr. | 528/186 |
| 4,792,480 | A | * | 12/1988 | Freund et al. | 442/378 |
| 4,816,328 | A | * | 3/1989 | Saville et al. | 442/289 |
| 4,868,928 | A | * | 9/1989 | Norvell | 2/272 |
| 4,950,523 | A | * | 8/1990 | Raszewski | 428/159 |
| 4,994,317 | A | * | 2/1991 | Dugan et al. | 442/72 |
| 5,082,721 | A | * | 1/1992 | Smith et al. | 442/289 |

(Continued)

FOREIGN PATENT DOCUMENTS

DE 8406746 * 6/1984

OTHER PUBLICATIONS

PRO Warrington: 5050 Struximity, Leather Proximity and Structural Bunker Boots, NFPA 1971, TheFireStore, http://www.thefirestore.com/store/product.cfm?pID=7346, 4 pgs.

(Continued)

*Primary Examiner* — Khoa Huynh
*Assistant Examiner* — Timothy K Trieu
(74) *Attorney, Agent, or Firm* — Finch & Maloney PLLC

(57) ABSTRACT

Protective garment for environments having high radiant heat loads and/or high conductive heat loads is described. A protective footwear article and method of making includes an upper with an opaque outer layer; an inner layer; and a thermally reflective layer positioned between the outer layer and the inner layer, the thermally reflective layer having a reflective surface facing the outer layer.

18 Claims, 7 Drawing Sheets

(56) References Cited

U.S. PATENT DOCUMENTS

| | | | | |
|---|---|---|---|---|
| 5,098,778 | A * | 3/1992 | Minnick | 442/224 |
| 5,101,579 | A * | 4/1992 | Terlizzi et al. | 36/8.3 |
| 5,471,906 | A * | 12/1995 | Bachner et al. | 2/2.5 |
| 5,514,459 | A * | 5/1996 | Blauer et al. | 442/220 |
| 5,575,090 | A * | 11/1996 | Condini | 36/54 |
| 5,593,754 | A * | 1/1997 | Blauer et al. | 428/131 |
| 5,727,401 | A * | 3/1998 | Statham | 66/176 |
| 5,811,359 | A * | 9/1998 | Romanowski | 442/261 |
| 5,925,441 | A * | 7/1999 | Blauer et al. | 428/196 |
| 5,935,882 | A * | 8/1999 | Fujita et al. | 442/247 |
| 5,948,708 | A * | 9/1999 | Langley | 442/131 |
| 6,048,810 | A * | 4/2000 | Baychar | 442/370 |
| 6,276,254 | B1 * | 8/2001 | Cordova et al. | 89/36.02 |
| 6,474,001 | B1 * | 11/2002 | Chen | 36/55 |
| 6,474,002 | B2 * | 11/2002 | Chen | 36/55 |
| 6,479,009 | B1 * | 11/2002 | Zlatkus | 264/510 |
| 6,631,569 | B1 * | 10/2003 | Scharbius et al. | 36/72 R |
| 7,015,288 | B2 * | 3/2006 | Pelosi et al. | 525/379 |
| 7,119,036 | B2 * | 10/2006 | Maini | 442/197 |
| 7,284,283 | B2 * | 10/2007 | Mack et al. | 2/161.6 |
| 7,437,775 | B2 * | 10/2008 | Reynolds | 2/87 |
| 7,595,104 | B2 * | 9/2009 | Romanowski | 428/40.1 |
| 7,624,456 | B2 * | 12/2009 | Williams et al. | 2/169 |
| 7,718,555 | B1 * | 5/2010 | Smith et al. | 442/50 |
| 8,062,411 | B2 * | 11/2011 | von Blucher et al. | 96/135 |
| 8,176,659 | B2 * | 5/2012 | von Blucher | 36/113 |
| 8,186,080 | B2 * | 5/2012 | Favreau et al. | 36/72 R |
| 8,187,984 | B2 * | 5/2012 | Rock | 442/64 |
| 8,247,077 | B2 * | 8/2012 | Danielsson | 428/421 |
| 2002/0035796 | A1 * | 3/2002 | Knoche et al. | 36/59 R |
| 2002/0069453 | A1 * | 6/2002 | Kelleher et al. | 2/458 |
| 2003/0236047 | A1 * | 12/2003 | Ramkumar | 442/340 |
| 2004/0200094 | A1 * | 10/2004 | Baychar | 36/55 |
| 2005/0050619 | A1 * | 3/2005 | Dunn | 2/458 |
| 2005/0076541 | A1 * | 4/2005 | von Blucher | 36/113 |
| 2005/0155131 | A1 * | 7/2005 | Underwood et al. | 2/85 |
| 2005/0165174 | A1 * | 7/2005 | Pelosi et al. | 525/379 |
| 2006/0079651 | A1 * | 4/2006 | Chen | 525/453 |
| 2006/0130367 | A1 * | 6/2006 | Liu | 36/55 |
| 2007/0101617 | A1 * | 5/2007 | Brewer et al. | 36/103 |
| 2007/0294920 | A1 * | 12/2007 | Baychar | 36/113 |
| 2008/0282578 | A1 * | 11/2008 | von Blucher | 36/98 |
| 2009/0300833 | A1 * | 12/2009 | Kampert et al. | 2/458 |
| 2009/0320190 | A1 * | 12/2009 | Waters et al. | 2/456 |
| 2010/0146686 | A1 * | 6/2010 | Winterhalter et al. | 2/458 |
| 2010/0223712 | A1 * | 9/2010 | Stachler et al. | 2/82 |
| 2010/0223716 | A1 * | 9/2010 | Howard, Jr. | 2/457 |
| 2011/0107621 | A1 * | 5/2011 | Mordecai et al. | 36/113 |
| 2012/0260396 | A1 * | 10/2012 | Mordecai | 2/97 |

OTHER PUBLICATIONS

"Radiant Barrier". Wikipedia: The Free Encyclopedia. Wikimedia Foundation, Inc., date last updated Jul. 26, 2015, date accessed Aug. 10, 2015, https://en.wikipedia.org/wiki/Radiant_barrier, 9 pages.

"Use and Care of Proximity Fire Fighters Clothing", GENTEX, Aug. 10, 2015, 2 pages.

* cited by examiner

PROTECTIVE GARMENT HAVING A THERMALLY REFLECTIVE LAYER

CROSS-REFERENCE TO RELATED APPLICATIONS

The present application claims priority from U.S. patent application Ser. No. 61/259,426, filed Nov. 9, 2009, entitled Footwear Having a Thermally Reflective Layer, incorporated by reference herein and for which benefit of the priority date is hereby claimed.

BACKGROUND

1. Field of Invention

The invention relates to protective footwear and, in particular, to thermally reflective garments for use in environments where high radiant heat loads and/or high conductive heat loads may be encountered.

2. Discussion of Related Art

Firefighters and other emergency responders can be exposed to a variety of hazardous conditions such as flame, smoke, high heat, poisonous atmospheres, biological contamination and radiological contamination. Garments used by these professionals may be designed to protect against one or more of these specific conditions. Footwear, such as boots, may also be specifically designed and can be, for example, thermally insulated, waterproof, fire resistant or resistant to chemical attack. As one example, gear designed for use in proximity firefighting must be able to withstand extreme heat and should be capable of protecting the responder as provided in NFPA 1971: "Standard on Protective Ensembles for Structural Fire Fighting and Proximity Fire Fighting."

SUMMARY

In one aspect, protective footwear is provided comprising an opaque outer layer, an inner layer, and a thermally reflective layer positioned between the outer layer and the inner layer, the thermally reflective layer having a reflective surface facing the outer layer.

In another aspect, a method of making protective footwear is provided that includes positioning a thermally reflective layer between an outer layer and an inner layer, forming the thermally reflective layer, the outer layer, and the inner layer into the shape of an upper portion of the protective footwear, and attaching a sole to the upper portion.

In another aspect, a structural firefighting boot is provided, the boot capable of passing the additional performance requirements (7.12) for the proximity fire fighting protective footwear elements only test of NFPA 1971 (2007) wherein the boot comprises an upper having a total thickness of less than 1.5 cm and a non-reflective outer surface.

The subject matter of this application may involve, in some cases, interrelated products, alternative solutions to a particular problem, and/or a plurality of different uses of a single system or article.

The present invention is not intended to be limited to a system or method that must satisfy one or more of any stated objects or features of the invention. It is also important to note that the present invention is not limited to the exemplary or primary embodiments described herein. Modifications and substitutions by one of ordinary skill in the art are considered to be within the scope of the present invention, which is not to be limited except by the following claims.

DETAILED DESCRIPTION

Figure 1:
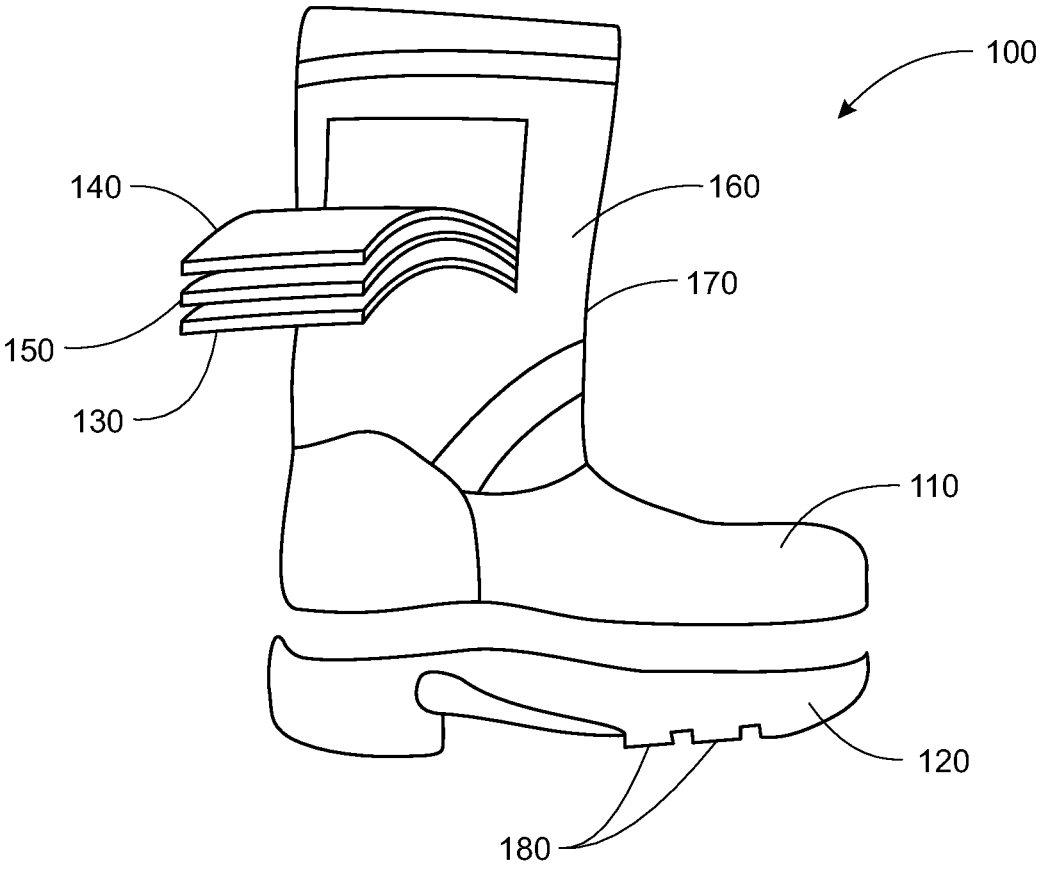
FIG. 1 is an exploded and cutaway view of one embodiment of an upper and sole of the invention.

There are two major types of thermally protective footwear worn by firefighters and other personnel working near fires: proximity footwear and structural footwear. Proximity footwear is designed for working close to large open flame fires such as those caused by aviation fuel released during plane crashes. Proximity footwear requires specialized thermal protection due to the high radiant heat loads that can be encountered. Structural footwear is the most commonly utilized thermally protective footwear and is utilized by firefighters to make entry into burning buildings. Structural footwear provides limited thermal protection, provides a moderate level of physical hazard protection, and may be an insulated leather or rubber boot.

In a conventional construction, proximity protective footwear of the type satisfying NFPA 1971 has a metalized external surface to reflect radiant heat away from the firefighter. The metalized surface may be mechanically less durable than other footwear materials, such as rubber or leather, and may be more susceptible to punctures, cuts, and abrasions. Also, the external metalized surface can be difficult to keep clean since scrubbing the material can cause extensive wear and degradation of the surface. Unfortunately, as the metalized surface is damaged or becomes dirty, it loses its ability to reflect heat, and the firefighter's life is put at greater risk. In addition, footwear having a metalized exterior surface is generally less favored by firefighters when given a choice of a leather boot or a metalized boot.

Structural protective footwear may have an external surface made of leather or rubber. Compared to metalized materials, the external materials used in structural protective footwear can be durable, easy to clean, and may be more comfortable to wear. Structural protective footwear is generally better at withstanding many of the mechanical hazards found on the job that might otherwise damage a metalized surface on proximity footwear.

The protective footwear described herein, a boot for example, may be used by any person exposed to, or potentially exposed to, a heat source. For example, the footwear may be used by a firefighter to extinguish a fire or to perform a rescue from a burning building. The footwear may also be used by an industrial worker, for example a kiln operator or maintenance person. As another example, the footwear may be used by military servicemen exposed to a fire in the line of duty.

In one aspect, a protective footwear article is disclosed that has a thermally reflective layer located underneath an outer layer of the footwear, rather than as the outermost layer of the footwear. The protective footwear may be any type of footwear, such as a boot, shoe, or a covering for a boot or shoe. In one embodiment, thermally protective footwear may be a boot. In a further embodiment, thermally protective footwear may be a structural firefighting boot. A structural boot can be durable and easy to clean, and it can provide a firefighter or other wearer with the proper fit, traction, and capacity for ease of movement and agility. The boot can satisfy the requirements of NFPA 1971 (2007) for proximity firefighting and may have a total thickness of the upper of less than 2 cm, less than 1.5 cm or less than 1 cm.

In one embodiment, the outer layer of the footwear may be made of any flexible, heat resistant, solid material, such as leather or a natural or synthetic polymer such as rubber, polyurethane, polyvinyl chloride (PVC), or PTFE. The outer layer can be opaque with respect to visible light and may be made from a heavyweight, flame-resistant and waterproof leather. The outer layer may include portions of light reflective material for added nighttime visibility. In different embodiments the thickness of the outer layer may be between about 0.25 and 5 mm, between about 2 and 4 mm, or between about 2.5 and 3.5 mm.

The reflective layer, located underneath the outer layer, may be any appropriate thermally reflective material, such as a metalized material. For example, the reflective layer may be a knit substrate supporting an aluminized film. The knit substrate may be a flexible material and in one embodiment the knit substrate is a combination of polybenzimidazole (PBI) and poly-paraphenylene terephthalamide, for example, (KEVLAR®). In a further embodiment, the knit substrate may be about 33 percent PBI and about 67 percent Kevlar and weigh about five ounces per square yard. In one set of embodiments, the reflective layer may be a PBI and Kevlar knit substrate laminated with an aluminized film. The aluminized film may be of any weight and thickness that is capable of being used as a middle layer and is capable of reflecting or preventing the conduction of enough heat and thermal radiation to meet the requirements of NFPA 1971. The aluminized film may be coated or uncoated. The reflective film itself may have a thickness of, for example, between about 0.01 and 0.5 mm. In one set of embodiments the aluminum film has a thickness between about 0.05 and 0.1 mm. In some cases, the film (void of any backing material) may weigh about two ounces per square yard, so that the combined weight of the knit substrate and aluminized film layer may be about 7.5 ounces per square yard (255 g/m$^2$). In a further embodiment, the reflective layer, including an aluminized film and a knit substrate, is about 0.9 mm thick. An appropriate reflective layer material is available from Gentex Corporation and is referred to as PA255 Jersey. It includes a GENTEX® Dual Mirror Aluminized Fabric on a PBI/Kevlar backing substrate.

The thermally reflective layer may be included in any part of the footwear, including an upper and a sole. In one set of embodiments, the thermally reflective layer is included in only the upper. In a further embodiment, the thermally reflective layer is included in only one or more specific sections of the upper.

The thermally reflective layer may be a reflector of radiant heat (infrared light) and can also serve to limit heat conduction. Different types of thermally reflective materials that can be used to form the thermally reflective layer may reflect more than 30%, more than 50%, more than 60%, more than 70%, more than 80% or more than about 95% of the radiant heat that is incident to the material. These materials can often be identified by their ability to reflect visible light and may reflect more than 50% of the visible light that is incident to the material. Examples of thermally reflective materials are metal coated fabrics and metallic foils. Thermally reflective materials may be flexible so that they can, for instance, conform to the movements of the footwear upper without cracking or restricting movement of the footwear.

In another embodiment, the protective footwear may include at least one inner layer located between the thermally reflective layer and the interior of the footwear. The inner layer may be made of two, three or more sub-layers that can be adhered together. In some embodiments, the footwear may include two or three independent, unbound, inner layers positioned between the reflective layer and the interior of the footwear. An inner layer may include one or more thermally insulating materials. For example, the inner layer may include one or more layers of non-woven fabric comprised of 65% meta-aramid material (such as NOMEX®) and about 35% poly-paraphenylene terephthalamide (such as KEVLAR®). When evaluated for heat resistance using industry standard techniques, the thermal conductivity of the inner layer may be between about 0.035 and 0.16 W/m-K. In another embodiment, the thermal conductivity of the inner layer may be between about 0.035 and 0.06 W/m-K. In another embodiment, an inner layer may include a moisture barrier such as a PTFE membrane (CROSSTECH® membrane). The moisture barrier layer may be adhered to a backing such as a non-woven nylon. For instance, the inner layer may include a moisture barrier (e.g., PTFE membrane) a polyester felt insulation layer, and a layer of non-woven nylon (such as CAMBRELLE® fabric). The moisture barrier layer may be facing outwardly and the non-woven nylon layer may be facing inwardly, toward the foot and ankle of the wearer. Additionally, the thickness of the inner layer may be similar to other thermal layers used in structural footwear and can be, for example, between about 0.02 and 15 mm. In a specific embodiment, the thickness of an inner layer may be between about 6 and 9 mm. This thickness can be achieved through the use of one, two, three or more thermal layers. Two or more thermal insulating layers may be separate from each other and can include an air layer between the two thermal insulating layers. The total thickness of this upper, including outer flame and water resistant leather, middle reflectivity layer and inner insulating and water resistant layer(s) can be less than 1.5 cm, less than 1.2 cm, or less than 1.0 cm and can still meet the requirements of NFPA 1971 for proximity firefighting footwear. This construction can provide light, flexible, comfortable footwear that can be used in proximity firefighting. The total weight per area of the upper, including all these layers, may be between about 2.0 and 4.0 kg/m$^2$, or it may be between about 2.5 and 3.5 kg/m$^2$. In some cases, the weight per area of the upper is less than 4.0 kg/m$^2$, less than 3.5 kg/m$^2$, or less than or equal to 3.2 kg/m$^2$.

The thermally reflective layer may be physically attached to an outer layer, an inner layer, or both. In other embodiments the thermally reflective layer may be simply placed between the outer and inner layers and may float between them. If attached, the thermally reflective layer may be fixed to either or both of the inner and outer layers using, for example, adhesive, stitching, staples, rivets or other mechanical fasteners.

FIG. 1 illustrates one embodiment of thermally protective footwear 100. Footwear 100 includes an upper 110 attached to a sole 120. Upper 110 is comprised of an outer layer 130, an inner layer 140, and a thermally reflective layer 150. An outer surface 160 of outer layer 130 defines an exterior surface 170 of upper 110. Thermally reflective layer 150 is positioned between outer layer 130 and inner layer 140. Sole 120 includes treads 180.

Figure 2:
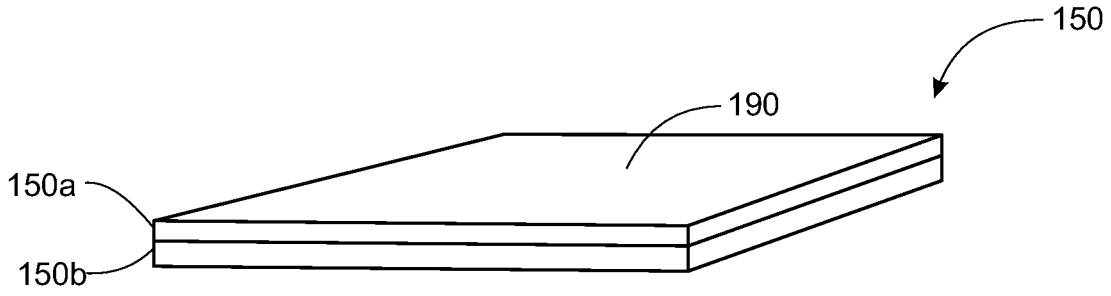
FIG. 2 shows a thermally reflective layer according to one embodiment of the invention.

In an embodiment shown in FIG. 2, thermally reflective layer 150 includes an aluminized film 150*a* and a knit substrate 150*b*. Aluminized film 150*a* includes a reflective surface 190. When incorporated into thermally protective footwear 100, thermally reflective layer 150 can be positioned with reflective surface 190 facing exterior surface 170.

Figure 3:
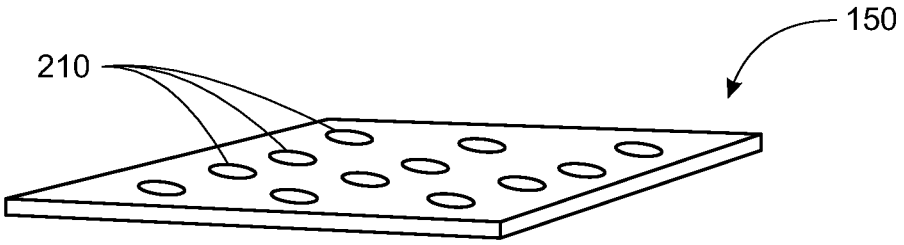
FIG. 3 shows a thermally reflective layer having vents according to one embodiment of the invention.

FIG. 3 shows a further embodiment in which thermally reflective layer 150 defines vents 210 to facilitate the flow of water vapor and other gases through thermally reflective layer 150. Vents 210 may be circular, as shown, but they may have any other shape, such as rectangular, square, or triangular and may be randomly placed or may be in a pattern. Vents may be of any appropriate size and may be as small as about 1 micron across. Vents may also be perforations in the thermally reflective layer 150. The perforations may facilitate the flow of water vapor and other gases through the thermally reflective layer 150.

Figure 4A:
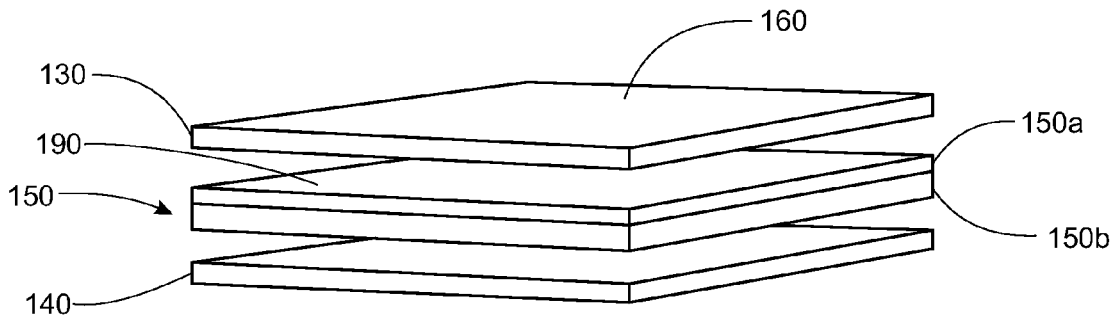
FIG. 4*a* shows an exploded view of an outer layer, an inner layer, and a thermally reflective layer according to one embodiment of the invention.
Figure 4B:
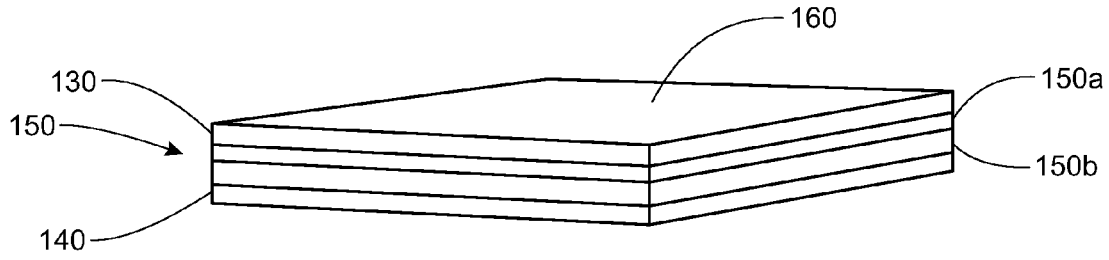
FIG. 4*b* shows an outer layer, an inner layer, and a thermally reflective layer in contact with one another according to one embodiment of the invention.

FIGS. 4*a* and 4*b* further illustrate the construction of upper 110. FIG. 4*a* shows outer layer 130, inner layer 140, and reflective layer 150 separated from one another. As indicated, reflective layer 150 is positioned between outer layer 130 and inner layer 140. FIG. 4*b* shows outer layer 130, inner layer 140, and reflective layer 150 in contact with one another.

Figure 5A:
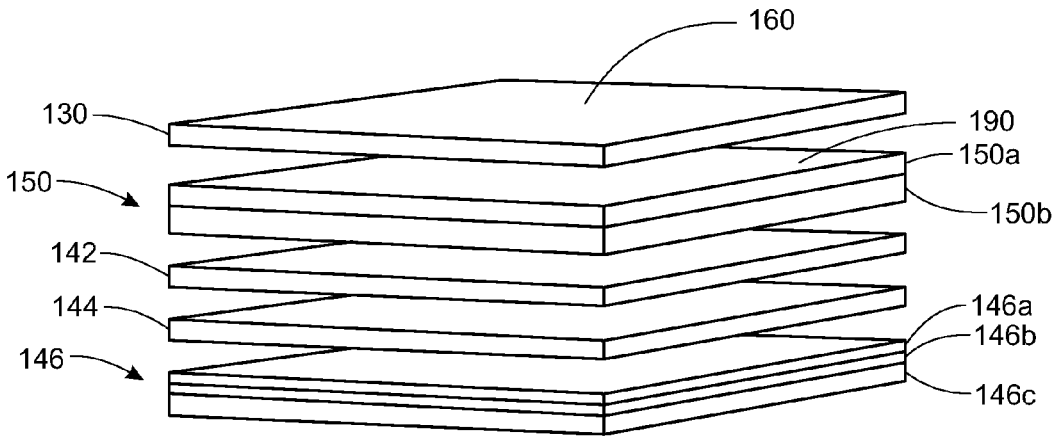
FIG. 5*a* shows an exploded view of an outer layer, multiple inner layers, and a thermally reflective layer according to one embodiment of the invention.
Figure 5B:
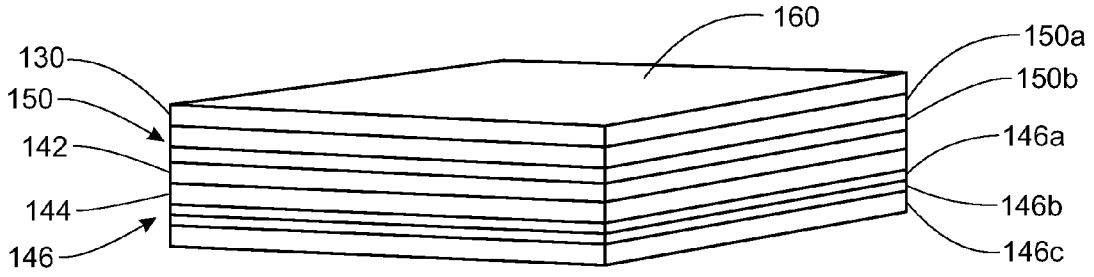
FIG. 5*b* shows an outer layer, multiple inner layers, and a thermally reflective layer in contact with one another according to one embodiment of the invention.

FIGS. 5*a* and 5*b* illustrate an embodiment of upper 110 in which inner layer 140 is comprised of a first inner layer 142, a second inner layer 144, and a third inner layer 146. FIGS. 5*a* and 5*b* show outer layer 130, reflective layer 150, first inner layer 142, second inner layer 144, and third inner layer 146 separated from one another and in contact with one another, respectively. In a particular embodiment, first inner layer 142 and second inner layer 144 are each made of KEVLAR and NOMEX woven fabric weighing about 7.5 ounces per square yard (255 g/m$^2$). By using both first inner layer 142 and second inner layer 144, rather than a single layer having the same thickness as the sum of the first inner layer and second inner layer combined, thermal insulation may be improved even though the same total amount of material is used. This improvement may be due to insulative air pockets that are formed between the two layers. Third inner layer 146 may be made of three sub-layers and may include a PTFE material 146*a*, such as CROSSTECH PTFE membrane fabric, a 300 g polyester felt insulation sub-layer 146*b*, and a quilted non-woven nylon (CAMBRELLE) sub-layer 146*c*.

Figure 6:
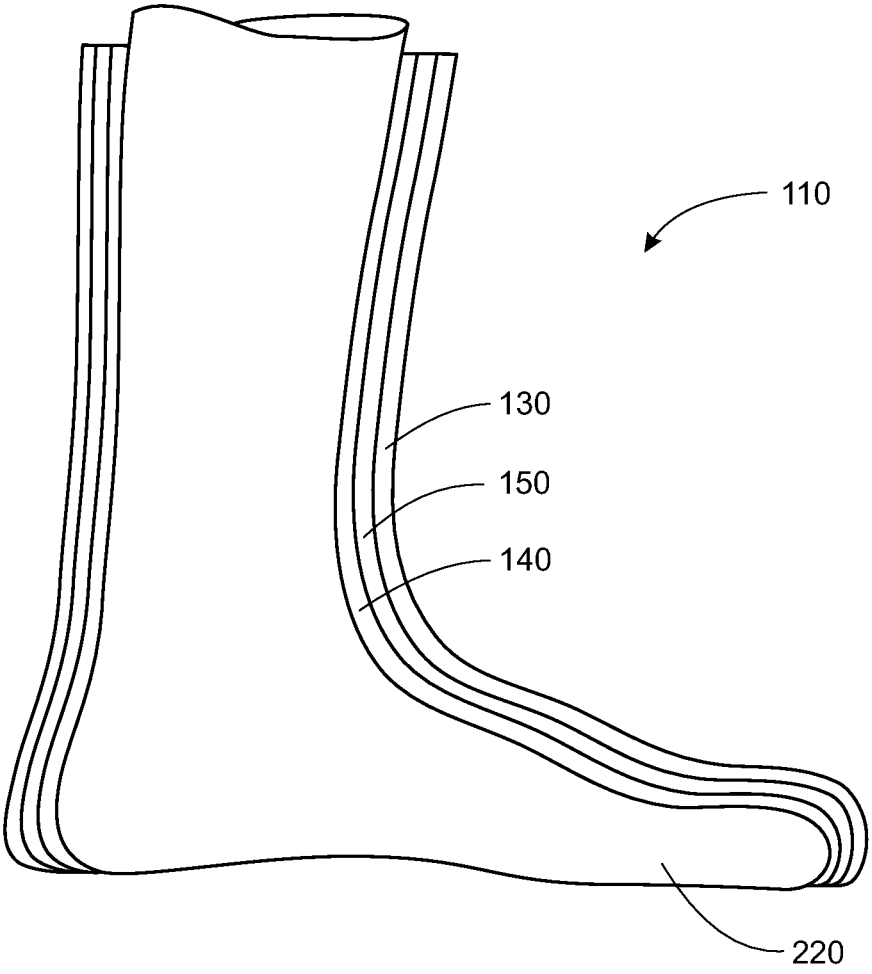
FIG. 6 is a cutaway view of an upper according to one embodiment of the invention.
Figure 7:
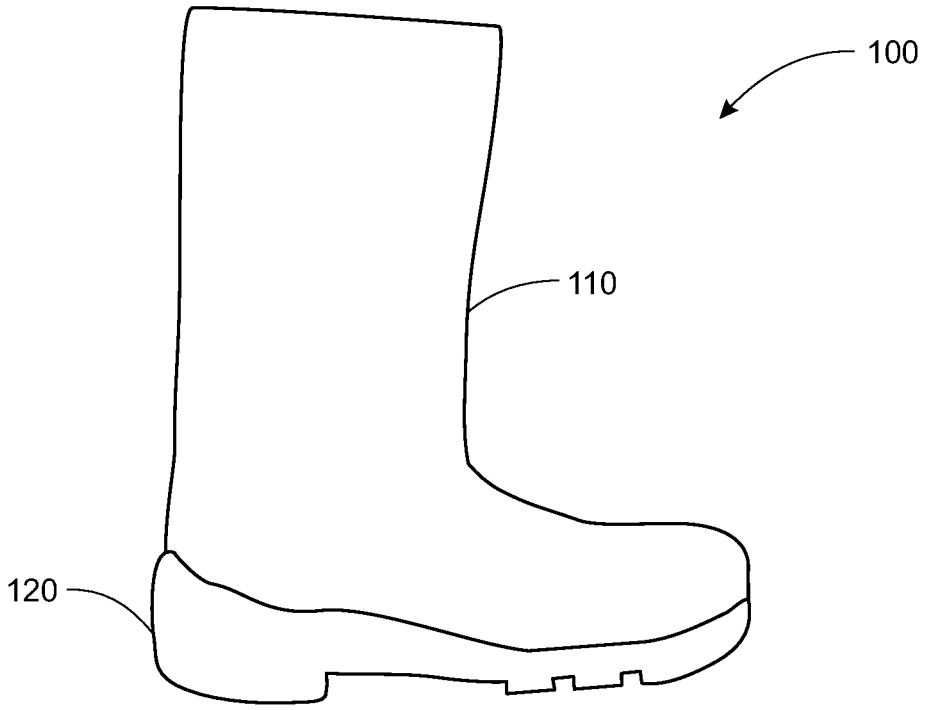
FIG. 7 shows an upper and sole according to one embodiment of the invention.

Protective footwear 100 may be produced using a process that can be illustrated using FIGS. 6 and 7. Upper 110 is formed by cutting outer layer 130, inner layer 140, and reflective layer 150 to the desired shape, wrapping outer layer 130, inner layer 140, and reflective layer 150 around a last 220, and fastening outer layer 130, inner layer 140, reflective layer 150 into position around last 220. Sole 120 is then attached to upper 110 with, for example, adhesive, stitching, staples, rivets, or other mechanical fasteners. As discussed above and shown in FIGS. 5*a* and 5*b*, inner layer 140 may include multiple layers.

Example

NFPA 1971 section 7.12 describes a set of performance tests that proximity firefighting footwear must satisfy in order to be NFPA 1971 compliant. Subsection 7.12.2 describes a Radiant Protective Performance test for evaluating radiant reflective capabilities. The procedure for this test, as specified in section 8.52 and ASTM F 1939 (Standard Test Method for Radiant Protective Performance), involves exposing five separate 75 mm×250 mm samples to 8.4 J/cm$^2$ (2 cal/cm$^2$). To satisfy the requirements of the Radiant Protective Performance test, the radiant reflective value for the footwear must not be less than 20 seconds.

Similarly, subsection 7.12.3 describes a Conductive Heat Resistance test for evaluating thermal insulation. As specified in section 8.60 and ASTM F 1060 (Standard Test Method for Thermal Protective Performance of Materials for Protective Clothing for Hot Surface Contact), the procedure for this test involves exposing three separate, whole footwear samples to a temperature of 100 degrees C. at a pressure of 3.45 kPa+/−0.35 kPa for a duration of 10 minutes. To satisfy the Conductive Heat Resistance test, the temperature within the footwear of the upper lining surface in contact with skin, averaged among the samples, shall not reach 44 degrees C. (111 degrees F.) in ten minutes or less.

Finally, subsection 7.12.4 describes a Radiant Heat Resistance test for evaluating thermal insulation. As specified in section 8.61, the procedure for this test involves using a radiometer to expose various portions of three separate, whole footwear samples to irradiance of 4.0 W+0.4/−0.0 W for 100 seconds. To satisfy the Radiant Heat Resistance test, the temperature within the footwear of the upper lining surface in contact with the skin, averaged among the samples, shall not exceed 44 degrees C. (111 degrees F.).

One embodiment of footwear 100 was tested and found to comply with the test requirements of NFPA 1971 section 7.12 (7.12.2, 7.12.3, and 7.12.4) described above. For these tests, footwear 100 was of a structural protective type. Outer layer 130 was made of opaque, heavyweight, flame-resistant and waterproof leather, and had a thickness of about 2.5 mm. Reflective layer 150 was a knit substrate of 33 percent PBI and 67 percent Kevlar laminated with an aluminized film. The thickness of reflective layer was about 0.5 mm. Inner layer 140 was comprised of three separate layers, as discussed above and shown in FIGS. 5*a* and 5*b*. Adjacent to reflective layer 150 were two layers of woven NOMEX and KEVLAR fabric (60/40 blend), each having a thickness of about 1.7 mm and weighing about 7.5 ounces per square yard (255 g/m$^2$). Adjacent to the innermost of the NOMEX/KEVLAR layers was a third layer having three sublayers that included one of CROSSTECH PTFE membrane, one of 300 gram polyester felt and one of quilted non-woven nylon (CAMBRELLE). This non-woven layer was the innermost layer of footwear 100. Inner layer 140 (i.e., the two NOMEX/KEVLAR layers and the PTFE/polyester/nylon layer combined) had a thickness of about 8 mm when held back-to-back but not under a source of compression. The entire upper, including all of the layers, had a thickness of about 1 cm when not under compression.

The performance of footwear 100 during the section 7.12 tests was better than expected as it was believed that the reflective layer had to be on the outer surface of the footwear to meet the requirements of NFPA 1971. Outer layers, such as those made of rubber or leather, are generally considered to be opaque and therefore should interfere with the ability of the reflective surface to reflect back infrared radiation. But the data from the test suggest otherwise. Specifically, thermally reflective layer 150 reflected away from footwear 100 a sufficient amount of the radiant heat received by footwear 100 to allow the footwear to pass 7.12.4. Even more surprising is that the internal reflective layer allowed the footwear to pass the Conductive Heat Resistance test of 7.12.3. A similar boot without the reflective layer, but with an additional thermal layer of greater thickness instead, failed the same test. Therefore, the use of an internally positioned reflective layer improved the conductive heat resistance of the boot so that it was able to meet the requirement.

Figure 8:
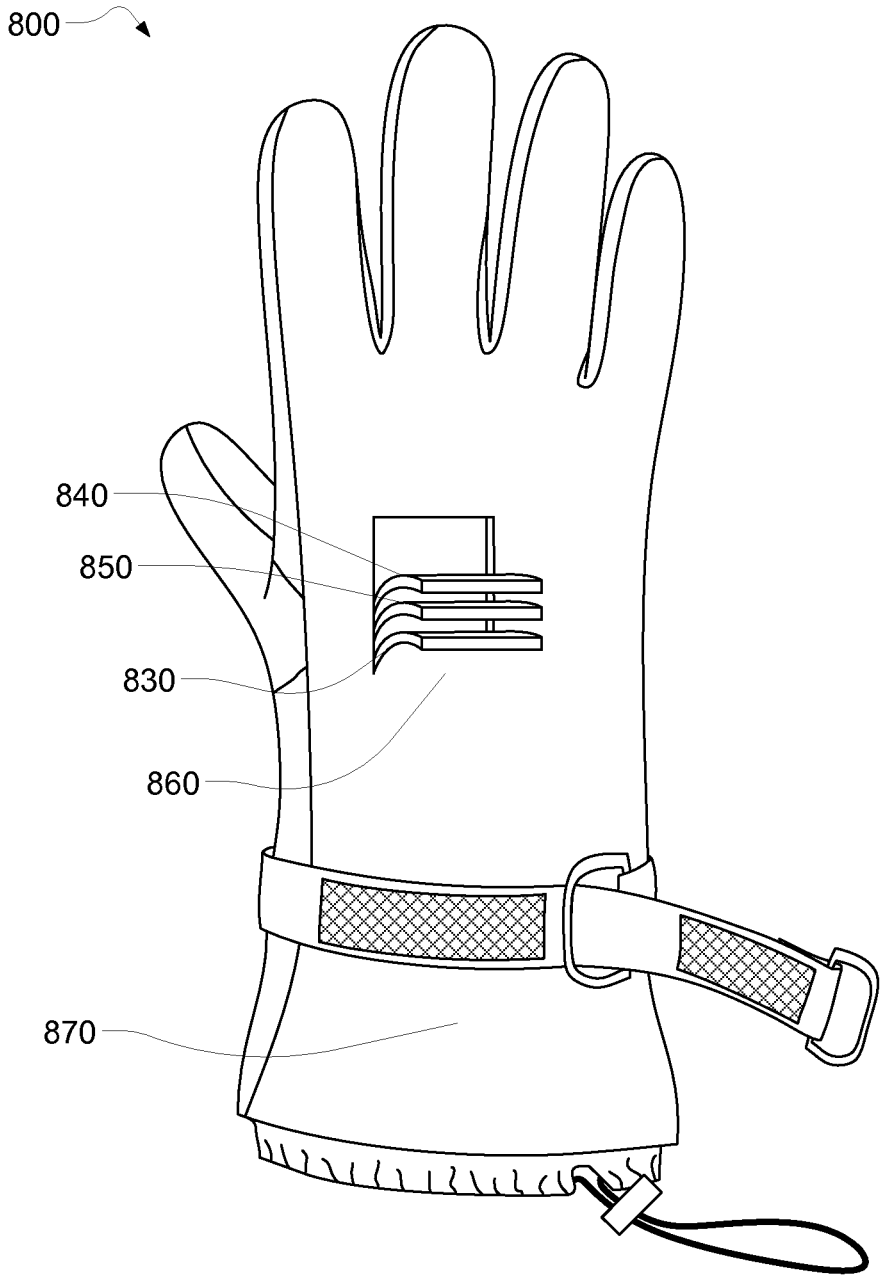
FIG. 8 is an exploded and cutaway view of one embodiment of a glove of the invention.

FIG. 8 illustrates one embodiment of thermally protective glove 800. The glove 800 may be comprised of an outer layer 830, an inner layer 840, and a thermally reflective layer 850. An outer surface 860 of outer layer 830 defines an exterior surface 870 of the glove 800. Thermally reflective layer 850 is positioned between the outer layer 830 and the inner layer 840.

The thermally reflective layer 850 may include an aluminized film and/or a knit substrate. Aluminized film includes a reflective surface. When incorporated into thermally protective glove 800, the thermally reflective layer 850 can be positioned with reflective surface facing exterior surface 870. The thermally protective glove 800 may include mittens or other protective hand garments. Various aspects as previous described in other embodiments herein may be incorporated in the thermally protective glove embodiment 800.

Protective glove 800 may be produced using various garment production processes. The glove 800 may be manufactured by cutting a top panel and a bottom panel each including the outer layer 830, the inner layer 840, and the reflective layer 850 to the desired hand pattern. The top panel and bottom panel are attached with, for example, adhesive, stitching, staples, rivets, or other mechanical fasteners. Various additional panels and seams may be used to provide a glove that better conforms to the contours of a user's hand.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

"Opaque" refers to a material that transmits less than 50 percent of incident visible light.

"Thermally reflective layer" refers to a layer of material having a radiant energy reflectivity. The thermally reflective layer may satisfy the NFPA 1971 2007 requirements. Some of these materials may reflect more than 50%, more than 70% or more than 90% of incident radiant heat (infrared).

All references, patents and patent applications and publications that are cited or referred to in this application are incorporated in their entirety herein by reference.

What is claimed is:

1. A protective footwear article that meets the requirements of NFPA 1971 section 7.12, the protective footwear article including a sole attached to an upper having one or more specific sections, at least one of the one or more specific sections of the upper comprising:

an outer layer, wherein the entire outer layer is opaque, flame resistant and exhibits less than 50 percent transmission of incident visible light;

an inner layer comprising fabric; and a thermally reflective layer positioned in between the opaque flame resistant outer layer and the inner layer, the thermally reflective layer consisting of a metalized material supported on a substrate, the metalized material of the thermally reflective layer being in direct contact with the outer layer, and the substrate of the thermally reflective layer being in direct contact with the inner layer when the upper is fully assembled.

2. The protective footwear article of claim 1 wherein the thermally reflective layer comprises an aluminized surface.

3. The protective footwear article of claim 1 wherein the substrate comprises a knit substrate.

4. The protective footwear article of claim 3 wherein the knit substrate comprises polybenzimidazole and poly-paraphenylene terephthalamide.

5. The protective footwear article of claim 4 wherein the knit substrate has a weight of about 5 ounces per square yard.

6. The protective footwear article of claim 1 wherein the reflective layer has a weight of about 7 ounces per square yard.

7. The protective footwear article of claim 1 wherein the thermally reflective layer defines at least one vent.

8. The protective footwear article of claim 1 wherein the protective footwear article is a boot.

9. The protective footwear article of claim 1 wherein the upper has a thickness of less than 1.5 cm.

10. The protective footwear article of claim 9 wherein the thermally reflective layer is positioned throughout the upper.

11. The protective footwear article of claim 1 wherein the opaque outer layer comprises leather.

12. The protective footwear article of claim 1 wherein the opaque outer layer has a thickness greater than 1 mm.

13. A method of making a protective footwear article comprising:

positioning a thermally reflective layer between an outer layer and an inner layer, the inner layer consisting of fabric, the entire outer layer being opaque and flame resistant, the thermally reflective layer consisting of a metalized material on a substrate and the outer layer exhibiting less than 50 percent transmission of incident visible light;

fully assembling the thermally reflective layer, the outer layer, and the inner layer into an upper of the protective footwear article wherein the metalized material of the thermally reflective layer is in direct contact with the outer layer and the substrate of the thermally reflective layer is in direct contact with the inner layer; and attaching a sole to the upper.

14. The method of claim 13 wherein metalized material is aluminized layer.

15. The method of claim 13 comprising adding one or more additional inner layers.

16. The method of claim 13 wherein the inner layer comprises a breathable waterproof membrane.

17. A structural firefighting boot capable of passing the additional performance requirements (7.12) for the proximity firefighting protective footwear elements only test of NFPA 1971 wherein the boot comprises a sole attached to an upper having a thickness of less than 1.5 cm, at least one section of the upper comprising:

an internal thermally reflective layer consisting of a metalized material on a substrate backing;

an internal layer comprising a flexible waterproof material; and an outer layer, wherein the entire outer layer is opaque and flame resistant and exhibits less than 50 percent transmission of incident visible light and has a non-reflective outer surface, wherein the metalized material of the internal thermally reflective layer is in direct contact with the opaque outer layer and the substrate backing of the internal thermally reflective layer is in direct contact with the internal layer.

18. The structural firefighting boot of claim 17 wherein the upper have a thickness of less than 1.2 cm.

* * * * *